US009802378B2

(12) United States Patent
Thies

(10) Patent No.: US 9,802,378 B2
(45) Date of Patent: Oct. 31, 2017

(54) APPARTUS FOR, AND METHOD OF, PRODUCING A BAG FROM PAPER, AND PAPER BAG

(71) Applicant: Windmoeller & Hoelscher KG, Lengerich (DE)

(72) Inventor: Joerg Christian Thies, Dissen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 797 days.

(21) Appl. No.: 14/080,952

(22) Filed: Nov. 15, 2013

(65) Prior Publication Data

US 2014/0274636 A1 Sep. 18, 2014

Related U.S. Application Data

(63) Continuation of application No. 12/734,676, filed as application No. PCT/EP2008/065491 on Nov. 13, 2008, now abandoned.

(51) Int. Cl.
*B31B 19/16* (2006.01)
*B31B 23/00* (2006.01)
(Continued)

(52) U.S. Cl.
CPC ..... *B31B 49/04* (2013.01); *B31B 19/00* (2013.01); *B31B 2219/022* (2013.01); *B31B 2219/145* (2013.01); *B31B 2219/26* (2013.01); *B31B 2219/6007* (2013.01); *B31B 2219/90* (2013.01); *B31B 2219/9009* (2013.01); *B31B 2221/10* (2013.01); *B31B 2237/40* (2013.01)

(58) Field of Classification Search
CPC ..... B31B 19/16; B31B 23/00; B31B 49/04; B31B 37/00; B31B 21/00
USPC ..... 493/186, 239, 234, 235
See application file for complete search history.

(56) References Cited

U.S. PATENT DOCUMENTS 2,855,832 A 10/1958 Mengis
3,203,323 A * 8/1965 Adams ..... B31B 19/90 383/89
(Continued)

FOREIGN PATENT DOCUMENTS

DE 35 29 746 3/1987
DE 43 14 685 11/1994
(Continued)

*Primary Examiner* — Andrew M Tecco
*Assistant Examiner* — Praachi M Pathak
(74) *Attorney, Agent, or Firm* — Jacobson Holman, PLLC.

(57) ABSTRACT

A bag machine for production of bags made of paper material includes an unwinding device to unwind and feed paper material in a transport direction (x), a device to produce weakening lines partially offset in direction (x), so that a first wall of the bag continues in at least one tab that extends beyond a second wall, a tube-forming device, in which side areas are folded to form an overlapping area, a separation device to separate tube sections along the weakening lines, and a bottom formation device, in which areas of a leading end of the tube section are folded and fastened onto an outer wall thereof. The machine has a device for application of adhesive surfaces to the paper material, with which an adhesive surface is applied to an area of the paper material that represents the side of the tab facing the second wall in the finished bag.

9 Claims, 3 Drawing Sheets

(51) Int. Cl.

| | |
|---|---|
| ***B31B 49/04*** | (2006.01) |
| ***B31B 37/00*** | (2006.01) |
| ***B31B 21/00*** | (2006.01) |
| ***B31B 19/00*** | (2006.01) |

(56) References Cited

U.S. PATENT DOCUMENTS 3,537,359 A 11/1970 Finke
3,613,288 A * 10/1971 Ross ..... B31B 19/14 493/234
3,850,724 A * 11/1974 Lehmacher ..... B29C 69/006 156/201
3,929,275 A * 12/1975 Bolling ..... B31B 37/00 383/111
4,003,780 A 1/1977 Cohn
4,913,693 A * 4/1990 Ball ..... B65D 75/563 493/194
4,997,504 A * 3/1991 Wood ..... B29C 66/71 156/204
5,002,220 A 3/1991 Safranski
5,421,805 A * 6/1995 Baxter ..... B31B 19/86 493/226
5,429,576 A * 7/1995 Doderer-Winkler .... B31B 19/90 156/517
5,776,285 A 7/1998 Blümle
5,952,025 A * 9/1999 Yannuzzi, Jr. ..... B31B 1/72 383/109
7,191,579 B2 3/2007 Bartholf et al.
8,241,194 B2 * 8/2012 Skopek ..... B29C 59/007 493/224
9,028,386 B2 * 5/2015 Fraser ..... B31B 19/26 493/186
9,434,492 B1 * 9/2016 Russell ..... B31B 23/00
2010/0311557 A1 * 12/2010 Thies ..... B31B 19/62 493/239
2013/0260977 A1 * 10/2013 Wakatabi ..... B65D 27/14 493/188

FOREIGN PATENT DOCUMENTS

EP 0 623 458 11/1994
GB 918 381 2/1963

* cited by examiner

APPARTUS FOR, AND METHOD OF, PRODUCING A BAG FROM PAPER, AND PAPER BAG

CROSS-REFERENCE TO RELATED APPLICATIONS

This application is a continuation application of U.S. application Ser. No. 12/734,676, filed Aug. 16, 2010, now abandoned, the disclosure of which is incorporated by reference as if fully set forth herein. The aforementioned U.S. Application Ser. No. 12/734,676 is a nationalization of PCT/EP2008/065491 filed Nov. 13, 2008, and published in German, which claims priority to DE 10 2007 054 714.7, filed Nov. 14, 2007.

BACKGROUND OF THE INVENTION

1. Field of Invention

The invention concerns a bag machine for production of bags made of paper material and a method for production of bags from paper material.

2. Description of the Prior Art

Such bag machines have long been known. Unexamined Patent Application DE 35 29 746 A1 gives a good overview of such machines. The production method for paper bags is also described here.

Bag machines generally initially include an unwinding device, in which sheet-like paper material is unwound. The material is then fed in a conveyor device to the actual bag machine. In a first processing step, which is conducted in a corresponding station, the sheet material is provided with cross-perforations or crosscuts, so that weakening lines are formed. A cutting and/or perforation tool is generally mounted on a rotating shaft for this purpose. This tool enters the sheet-like material, which is running over a mating-roll, in which case the weakening lines are formed. The paper material can be separated into sections along these weakening lines. The distance between two weakening lines therefore establishes the length of the bag. Separation into sections generally occurs after passing through a tube-forming station, in which the side areas of the sheet-like paper material are folded to form an overlapping area, in which the facing sides of the overlapping area are joined to each other, for example, by applying an appropriate paper glue. The wall of the tube material, including the longitudinal seam formed in this way, is generally referred to as the upper wall of the tube or tube section. The other wall is referred to as lower wall accordingly. It is also possible to insert gussets into the tube. Gusset formation preferably occurs together with actual tube formation. Before joining to a tube, the later overlapping area must be coated with glue, for example, starch glue, for permanent joining.

Once a tube is formed, the tube must be separated in the separation device to tube sections along the weakening lines.

An individual weakening line can have only perforations, but according to DE 35 29 746 A1 mentioned in the introduction, it can also include smooth cuts. A weakening line then generally includes several sections that assume different positions viewed in the transport direction, i.e., are offset relative to each other. The trend of the weakening line is then chosen, so that the end of the lower wall in front protrudes over the upper wall in front. In this way, it is possible in the subsequent process to fold the lower wall onto the upper wall, so that the inside of the lower wall comes to lie on the outside of the upper wall. For actual bottom formation, the part being folded is provided with glue before folding. In the trailing end open in the later bag, the upper wall then protrudes beyond the lower wall. In certain bags, however, before or during the separation process to individual tube sections, a section of the upper wall is additionally removed, so that even in the trailing end, the lower wall protrudes beyond the upper wall. The part of one wall protruding beyond the other wall is referred to as the tab. In the preamble of Claim 1, the wall, whose trailing end has the tab, is referred to as first wall, in which this applies, regardless of whether the wall is the upper wall or the lower wall.

Bags for numerous applications are produced in the described manner. If a product to be transported is filled into the bag, such a bag is generally closed. After filling, the upper end is often simply folded, repeatedly folded or rolled. To avoid independent recovery of these folds, these folds are often secured with an adhesive film strip applied manually. It was recognized that adhesive film strips are often not on hand when they are needed. Bags are therefore known, on which an adhesive surface was already applied to an outer wall during the manufacturing process. In order to securely close such a bag, only the protective layer protecting the adhesive surface, for example, a coated and therefore less adherent paper piece, need be pulled off and the open end of the bag folded once, so that the outer wall then lies on itself or the tab lies on the adhesive surface. It must then be kept in mind that the end of the bag covers the adhesive surface precisely. If the end is folded too short, areas of the adhesive surface are not covered. On the other hand, if the end is folded too far, the end itself is not fixed.

The bag can therefore be inadvertently reopened, for example, if it hangs up on other objects.

If the bag is to be correctly closed, essentially just a single format of the closed bag is obtained. However, this is often undesired, when the bag is only partly filled. In this case, it is therefore desirable to be able to fold the end so that the format of the filled bag is no larger than necessary. However, this is not possible with bags of the prior art, if they are supposed to offer the capability of being securely closed.

SUMMARY OF THE INVENTION

The task of the present invention is therefore to propose a bag machine and a method for production of bags, so that the bags no longer have the mentioned drawbacks.

This task is solved according to the invention by the features thereof as described herein.

According to this solution, a device for applying adhesive surfaces to the paper material is provided in the bag machine, with which an adhesive surface can be applied to an area of the paper material, which, in the finished bag, is the side of the tab facing the other wall. In other words, the adhesive surface is applied to the side of the tab that represents the extension of the inside wall.

With this method, the adhesive surface can therefore be directly arranged on the open end. In the ideal case, one edge of the adhesive surface directly abuts the cutting or perforation edge of the bag.

The open end of the bag can now be folded in any length and, at the same time, still be securely closed. The drawbacks of the bags of the prior art are overcome with such bags.

The adhesive surface can be produced in different ways. One way that works is to apply so-called labels to the paper material, which include a support material provided on both sides with the adhesive layer. This adhesive layer can be fastened to the paper material with the first side, while the second layer is covered by a protective sheet, which is pulled off right before use.

The adhesive surface, however, can also be produced by direct application of an adhesive. This application can occur by spraying of an appropriate adhesive. This adhesive should naturally be permanent. The adhesive must therefore also be covered by a protective sheet until use, which must be applied after application of the adhesive layer.

With the device just described, as already indicated, it is possible to produce gusseted bags instead of flat bags. In this case, the adhesive surface is applied preferably in the area of the tab, which is not covered by the gussets. This is therefore the part of the tab free from gussets. At a given size of the adhesive surface, however, the perforation contour can be configured instead, so that no gusset is present in the area of the adhesive surface. The possibility of also extending the adhesive surface to the part covered by the gussets, however, can also be implemented and is not disadvantageous. The gussets can then also be fastened, which imparts additional durability to the bag closure.

Application of adhesive surfaces, in principle, can occur after different manufacturing phases of the bag. Only after tube formation and before separation of the tube into tube sections, application of the adhesive surfaces is not possible on the inside of one of the two walls or only possible by additional design elements. During or after the subsequent manufacturing phases and in the corresponding processing stations, application of the adhesive surfaces is conceivable:

separation into tube sections
pre-rupture of the bottom fold
glue application for bottom gluing
folding of the bottom.

This list is not exhaustive. However, it is particularly advantageous to apply the glue surface before tube formation. The device for application of a glue surface is therefore situated first in an advantageous variant of the tube-forming device. Before tube formation, the paper material is still present as a sheet, so that all the areas of this sheet can still be reached. In particular, the entire surface that later forms the insides of the bag walls can be reached. Especially if the sheet with the layer outside of the bag lies on a surface, for example, the peripheral surface of a guide wall, the adhesive surface can be very simply positioned on the layer inside. The position of the adhesive surfaces is still also freely selectable, since no geometric restrictions are present. In particular, the position can be varied across the web transport direction. This variation is especially important, if bags, in which, as initially described, the lower wall protrudes beyond the upper wall on both the leading and trailing end are to be produced.

A special feature of the mentioned arrangement and procedure, i.e., application of the adhesive surface before tube formation, is that the adhesive surfaces are arranged within the tube before separation of the tube into tube sections.

During introduction of the weakening lines, the sheet runs on a roll that serves as a counter-support for a cutting and/or perforation blade. It is therefore conceivable to also apply the adhesive surface during introduction of the weakening line.

However, it is advantageous to arrange the device for application of the adhesive surfaces after the device for introduction of the weakening line. Arrangement of the device for application of adhesive surfaces can occur optionally at such a location, i.e., only if there is a requirement for such a device. This can also occur subsequently. In particular, the mentioned device is very simple to achieve here and therefore very suitable for maintenance.

Ahead of tube formation, the sheet-like paper material runs through a glue application device, with which a glue track is applied to the later overlapping area. The material then runs over a roll that represents the counter-surface for glue application. The device for application of adhesive surfaces can also be provided here, which also uses the roll as counter-surface. It is therefore particularly advantageous to provide a device at this location.

A particularly preferred embodiment of the invention involves synchronization of the device for application of adhesive surfaces with the device for producing weakening lines. A start pulse is then generated during introduction of a weakening line. Depending on the machine speed and the distance to the device for application of the adhesive surfaces from the position, at which the weakening line is introduced, a control device calculates the time, at which application of the adhesive layer must be started and/or stopped. If necessary, the size of the adhesive layer must also be considered, for example, if so-called labels are to be used.

In another embodiment of this bag machine, at least parts of the device for application of adhesive surfaces are transversely movable. For this purpose, two guides can be provided across the transport direction of the sheet. A motor driven spindle-nut combination can be provided for movement.

Additional practical examples of the invention are apparent from the description and claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
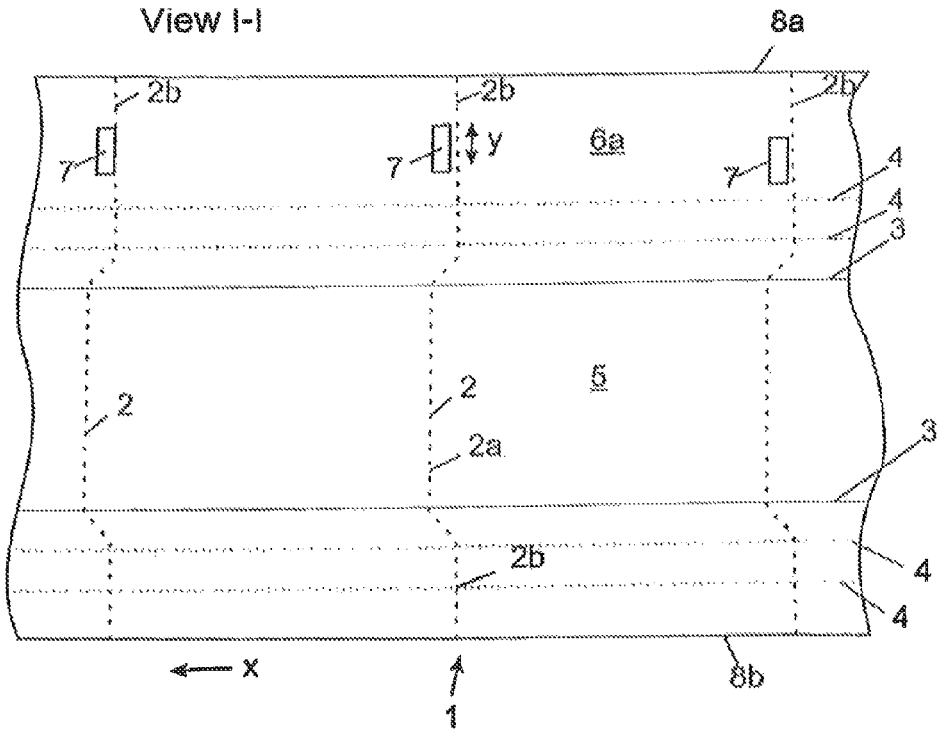
FIG. 1 Top view of the sheet-like paper material before tube formation

FIG. 1 shows sheet-like paper material 1 before actual formation, which is guided through the bag machine in transport direction x. Perforations 2 have already been introduced to this paper material 1, which essentially run across the transport direction x. It is apparent that sections of the perforations are arranged in transport direction x at different positions. Thus, the section 2*a* is shifted relative to the sections 2*b* in the transport direction. The lines running in the longitudinal direction show the longitudinal folding edges 3. It is apparent in the figure that the offset of sections 2*a* and 2*b* occurs in the region of these folding edges. The folding lines 4, around which the sheet-like material is folded during tube formation, if gusseted bags are to be produced, is shown with a dotted line.

The surface 5 designates the inside 5 of the lower wall. The surfaces 6*a* and 6*b*, after tube formation, represent the inside of the upper wall. In the depicted practical example, adhesive surfaces 7 are shown in surface 6*a*. The adhesive surfaces 7 are then applied to the paper material, so that they lie in the transport direction x fully in front of the perforation section 2*b*. However, only a relatively small surface should be present between the adhesive surfaces 7 and section 2*b*, so that adhesive surfaces 7 and section 2*b* are adjacent to each other. An adhesive surface 7 can additionally or as an alternative be arranged on surface 6*b*. The double arrow y indicates that the adhesive surface, as required, can be moved across the transport direction x and can therefore be arranged at any location.

Figure 2:
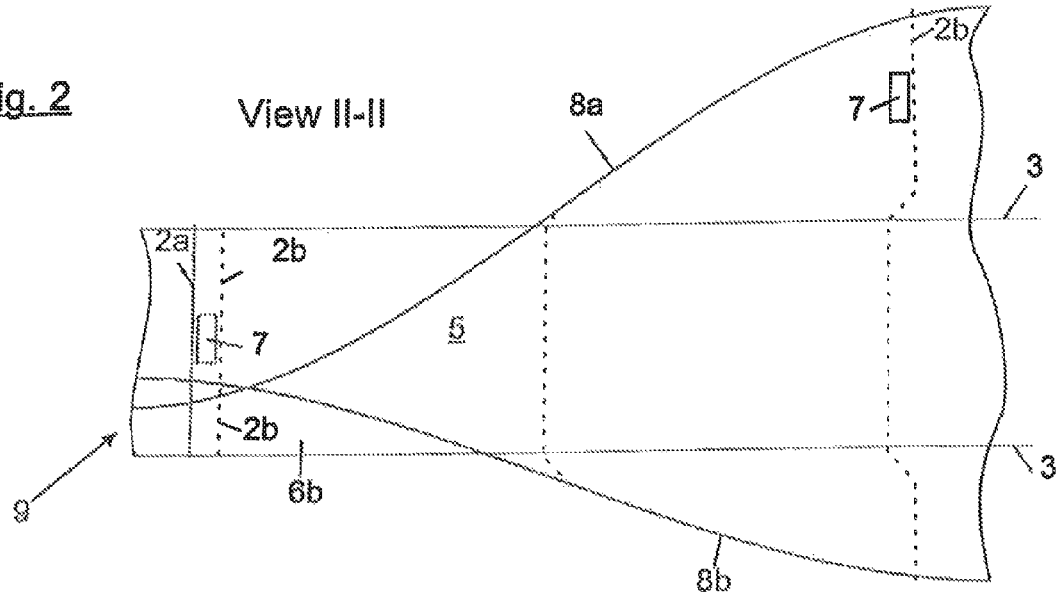
FIG. 2 Top view of tube formation

FIG. 2 shows a tube formation process. By means of appropriate guide elements in the bag machine, for example, by means of correspondingly bent guide plates, the sheet-like paper material 1 is folded. For this purpose, the sheet edges 8*a*, 8*b* are guided by the guide elements, so that they are positioned on surface 5, in which case folds are formed along the longitudinal folding edges 3. The insertion of gussets is known to one skilled in the art and is therefore not further described here.

During folding, the sheet edge 8*b* is first folded, followed by the sheet edge 8*a*, so that the edge 8*a*, after tube formation, remains visible. However, it is also conceivable that edge 8*a* is folded first and then edge 8*b*. In the top view of the tube 9 just formed, it is conspicuous that the perforation section 2*b* is visible, since it is introduced to the wall now lying on top. The adhesive surface 7 is now also situated in this wall lying on top. However, since it is situated in the tube interior and is not visible in the top view, it is shown with a dotted line in FIG. 2. The perforation section 2*a* is now also not visible, since the surface 5, into which it is introduced, is now covered by the surfaces 6*a* and 6*b*, so that section 2*a* is also shown with a dotted line. It is apparent in FIG. 2 that the extent of the adhesive surface 7 in transport direction x advantageously at a maximum is equal to the difference in positions of sections 2*a* and 2*b*. In this way, the adhesive surface is restricted to the area of tab 10, which is apparent in FIGS. 3 and 4.

Figure 3:
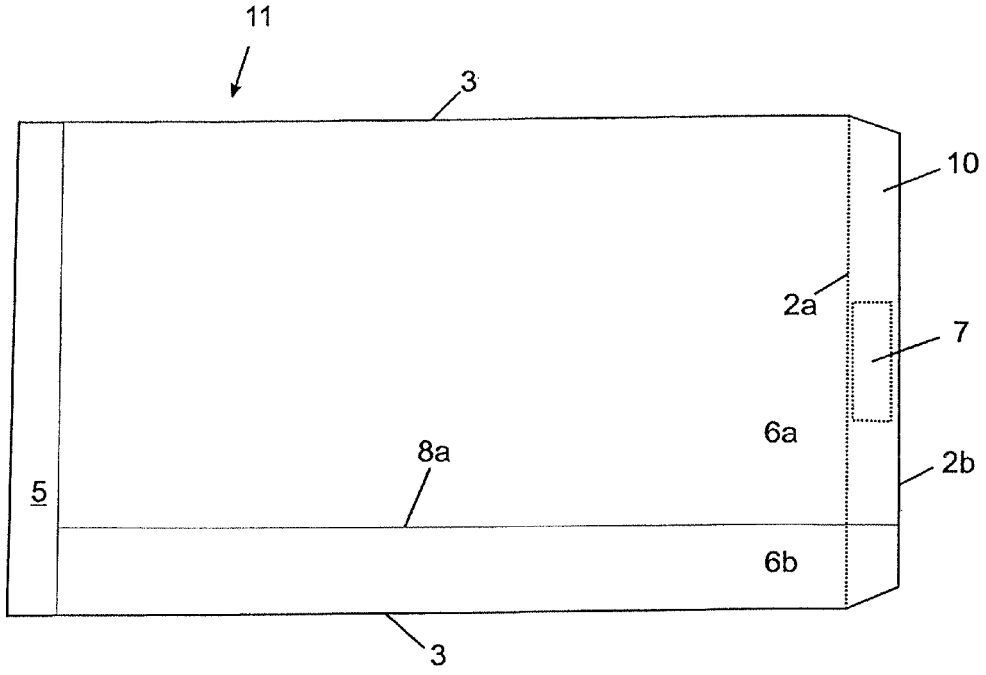
FIG. 3 Top view of a finished bag

FIG. 3 shows the tube 9 after it has been separated into tube sections. This separation generally occurs by guiding the tube through a first roll gap. The rolls of an additional roll gap following in the transport direction and separated from the first roll gap by at least one tube section length, are driven with higher speed than the rolls of the first roll gap. When the rolls of the additional roll gap grasp the leading end of tube 9, it tears along the weakening line of perforation 2. After separation, the leading end of the tube section, which consists at least of an extension of lower surface 5, is folded and fastened onto the upper wall, which includes surfaces 6*a* and *b*.

The folding edges 3 now form the longitudinal sides of bag 11. Projection of the perforation section 2*a* of surface 5 and perforation section 2*b* now delimit the tab 10, on whose inside the adhesive surface 7 is now arranged.

Figure 4:
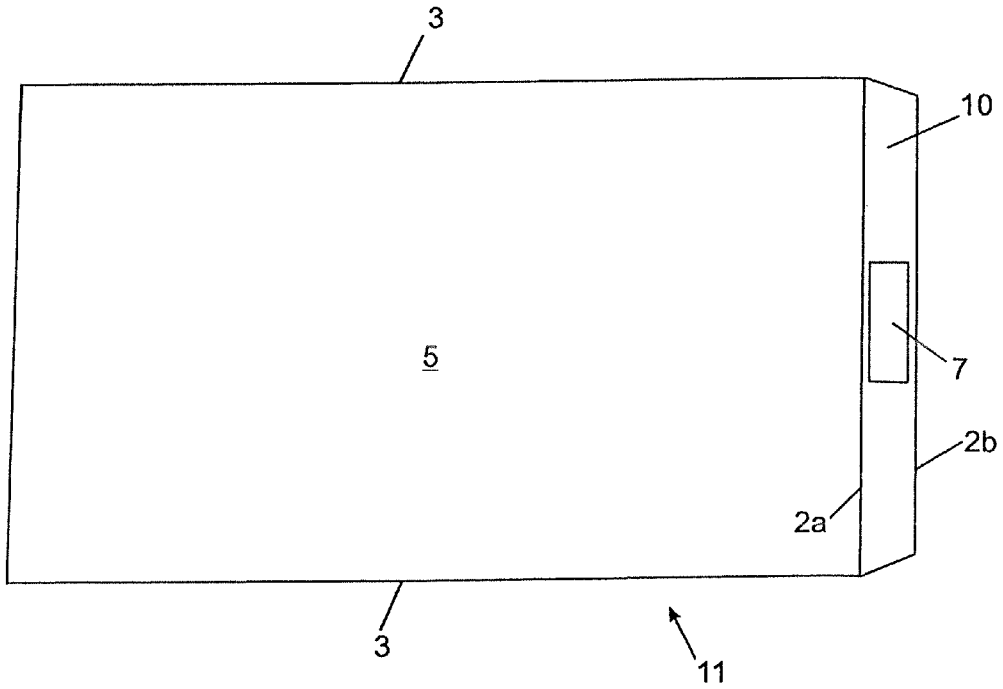
FIG. 4 View of a finished bag from below

FIG. 4 shows the same bag as in FIG. 3, merely turned around the longitudinal axis, so that the bottom is visible.

Figure 5:
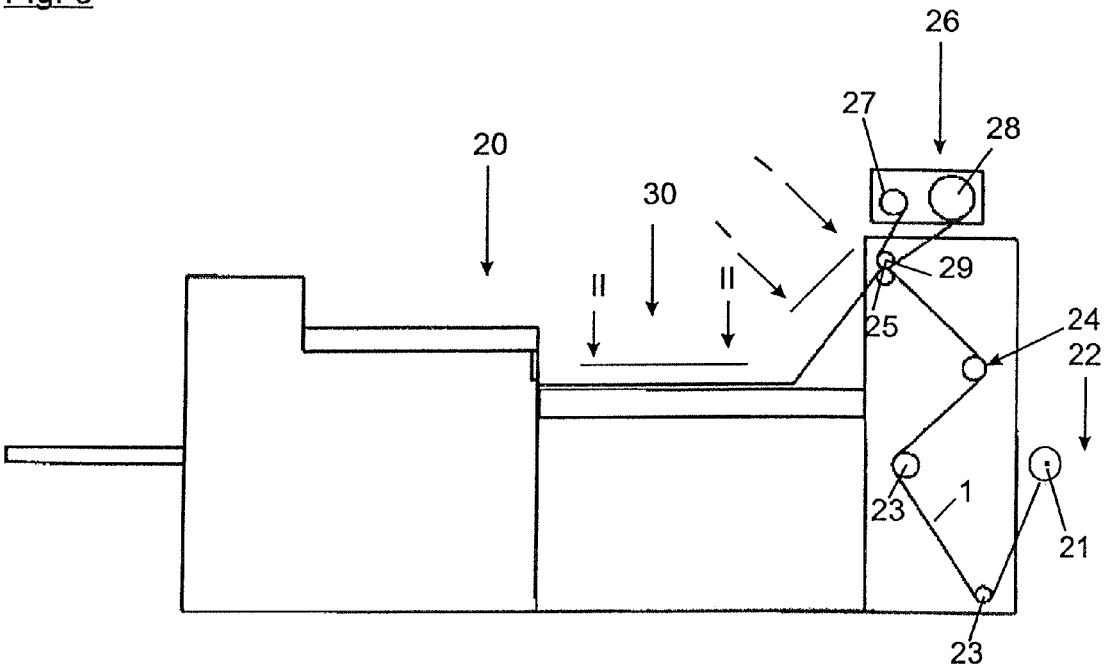
FIG. 5 Side view of a bag machine according to the invention

FIG. 5 schematically depicts a bag machine 20 according to the invention. The sheet-like paper material 21 is wound on a roll in unwinding station 22 and is guided from there by deflection rolls 23 to the perforation station 24 (not further shown).

From there the sheet-like material goes to a counter-roll 25. This roll serves as counter-position for the labeling station 26. A roll 27 is situated in this station with a strip, on which individual labels are applied, which are adhesive on both sides. This strip is unwound from roll 27 in cycles. In each cycle, an individual label is applied at a precalculated time to the sheet-like paper material 1. The pressure element 29 is used here to press on the label, which is formed roll-like in the depicted variant. The strip, which now no longer carries labels, is then wound onto roll 28 and can be disposed of from there. The sheet-like paper material provided with labels as described then goes to the tube-forming station 30 (not further shown) and then to additional stations for production of the bag. The rolls of the labeling station 26 can preferably be driven independently of the rest of the machine. The drive, however, is preferably controlled by control of the bag machine. A separate sensor for the drive, however, is also conceivable.

The labeling station can be provided as an optional attachment, which can be mounted on the side walls of the machine frame of the bag machine.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A bag machine for production of bags made of paper material, comprising:

an unwinding device to unwind and feed the paper material in a transport direction (x);

a device for producing a perforation, such that portions of the perforation are offset relative to each other in the transport direction (x), so that a first wall of a finished bag continues in at least one tab, which extends beyond a second wall thereof;

a tube formation device to form a tube, with which the side areas of the sheet are folded and joined to each other to form an overlapping area;

a separation device to separate a tube section along the perforation from the tube;

a bottom formation device, with which areas of a leading end of the tube section are folded and fastened to an outer wall of the tube section; and a device for applying to the paper material, directly adjacent to the perforation, an adhesive surface, the adhesive surface being (i) applied to an area of the paper material that represents a side of the tab facing the second wall in the finished bag and (ii) a piece of material having adhesive on bot sides thereof, one side of which is covered with a cover sheet, the device for applying the adhesive surface being located upstream, in the transport direction (x), of the tube formation device.

2. The bag machine according to claim 1, wherein for production of bags having gussets, the adhesive surface is applied to an area of the tab that is not covered by the gussets.

3. The bag machine according to claim 1, further comprising a device for producing folding lines, wherein the device for applying the adhesive surface is located downstream, in the transport direction (x), of the device for producing folding lines.

4. The bag machine according to claim 1, further comprising a longitudinal gluing device arranged upstream, in the transport direction (x), of the tube formation device, wherein the device for applying the adhesive surface is located adjacent the longitudinal gluing device.

5. The bag machine according to claim 1, wherein the device for applying the adhesive surface is synchronized with at least one of a cutting tool and a perforation tool associated with the device for producing the perforation.

6. The bag machine according to claim 1, wherein the device for applying the adhesive surface is movable across the transport direction (x) of the paper material or the bag.

7. The bag machine according to claim 1, wherein the device for applying the adhesive surface includes an unwinding device, in which a roll with a strip, on which adhesive labels are applied, is insertable.

8. A method for production of bags made of paper material, said method comprising the following steps:

unwinding a sheet of the paper material and feeding the unwound sheet of the paper material in a transport direction (x);

introducing a perforation, such that portions of the perforation are offset relative to each other in the transport direction (x), so that a first wall of a finished bag continues in at least a tab that extends beyond a second wall thereof;

forming a tube, in which side areas of the sheet are folded to form an overlapping area and join to each other;

separating tube sections along the perforation from the tube;

forming a bottom, with a leading end of the tube section being folded and fastened onto an outer wall of the tube section; and applying to the sheet, directly adjacent to the perforation, an adhesive surface, the adhesive surface being (i) applied to an area of the paper material that represents a side of the tab facing the second wall in the finished bag and (ii) a piece of material having adhesive on both sides thereof, one side of which is covered with a cover sheet, the step of applying the adhesive surface being performed before the step of forming the tube.

9. The method according to claim 8, wherein during production of bags having gussets, the adhesive surface is applied to an area of the tab that is not covered by the gussets.

* * * * *